US011852173B1

(12) United States Patent
Hussain et al.

(10) Patent No.: US 11,852,173 B1
(45) Date of Patent: Dec. 26, 2023

(54) SCREW-PUMP TYPE ELECTRO-HYDRAULIC ACTUATOR

(71) Applicants: Syed Mutahir Hussain, Calgary (CA); Shu Wang, Yorkville, WI (US)

(72) Inventors: Syed Mutahir Hussain, Calgary (CA); Shu Wang, Yorkville, WI (US)

(73) Assignees: ZOOMLION HEAVY INDUSTRY NA, INC., Yorkville, WI (US); ZOOMLION HEAVY INDUSTRY SCIENCE AND TECHNOLOGY CO. LTD., Changsha Hunan Province (CN)

( * ) Notice: Subject to any disclaimer, the term of this patent is extended or adjusted under 35 U.S.C. 154(b) by 0 days.

(21) Appl. No.: 18/207,768

(22) Filed: Jun. 9, 2023

(51) Int. Cl.

| | |
|---|---|
| ***F15B 15/06*** | (2006.01) |
| ***F04C 2/16*** | (2006.01) |
| ***F15B 15/18*** | (2006.01) |
| ***F15B 13/02*** | (2006.01) |
| ***F15B 1/04*** | (2006.01) |
| *F15B 15/08* | (2006.01) |

(52) U.S. Cl.
CPC ..... *F15B 15/068* (2013.01); *F04C 2/16* (2013.01); *F15B 1/04* (2013.01); *F15B 13/024* (2013.01); *F15B 13/027* (2013.01); *F15B 15/18* (2013.01); *F04C 2240/40* (2013.01); *F04C 2240/50* (2013.01); *F15B 15/088* (2013.01)

(58) Field of Classification Search
CPC ..... F15B 15/068; F04C 2/16
See application file for complete search history.

(56) References Cited

U.S. PATENT DOCUMENTS

| | | | | |
|---|---|---|---|---|
| 4,846,007 A * | 7/1989 | Weyer | F15B 15/068 | 74/424.92 |
| 7,267,044 B1 * | 9/2007 | Klinger | F15B 15/068 | 92/33 |
| 8,794,095 B2 * | 8/2014 | Merlet | F16H 57/0497 | 74/89.44 |

FOREIGN PATENT DOCUMENTS

| | | |
|---|---|---|
| EP | 2570343 | 3/2013 |

* cited by examiner

*Primary Examiner* — Michael Leslie
*Assistant Examiner* — Daniel S Collins
(74) *Attorney, Agent, or Firm* — Donald J. Ersler

(57) ABSTRACT

A screw-pump type electro-hydraulic actuator preferably includes an electric motor device, a hydraulic tube, a pump piston, a spline rod, an actuator rod and a hydraulic control circuit. The electric motor device preferably includes an electric motor and a gearbox. One end of the spline rod is engaged with an output of the gearbox. The pump piston preferably includes a piston base, three sets of screw pump rollers, a spline drive gear, a first piston end plate and a second piston end plate. The hydraulic flow circuit includes a first relief valve, a first check valve, a second relief valve, a second check valve and an accumulator. The screw pump rollers are rotatably retained in the piston base between the first and second piston end plates. The spline gear drives the pump driven gears of the three drive screw pump rollers through the spline drive gear to pump hydraulic oil.

20 Claims, 6 Drawing Sheets

SCREW-PUMP TYPE ELECTRO-HYDRAULIC ACTUATOR

BACKGROUND OF THE INVENTION

1. Field of the Invention

The present invention relates generally to heavy duty equipment and more specifically to a screw-pump type electro-hydraulic actuator, which can provide high precision movement with less maintenance requirements than a hydraulic cylinder.

2. Discussion of the Prior Art

In heavy duty machinery, linear hydraulic cylinders are used extensively, because they have important attributes including high power density, large load handling capability and shock resistance. Hydraulic cylinders are used in a range of heavy load-handling applications in outdoor construction, marine, material handling, aerospace, agriculture equipment, and in other applications. Electric linear actuators are popular in industrial manufacturing and conveying systems. The electric linear actuator includes a motor that powers a lead screw. The lead screw includes a ball nut, which is moved in a linear motion along the lead screw. Electric linear actuators can achieve high precision and speed with little or zero maintenance. However, electric linear cylinders are typically not suitable for harsh operating environments, strong workloads, and large shocks. Patent application no. EP2570343 discloses an electro hydraulic actuator.

Accordingly, there is clearly felt need in the art for a screw-pump type electro-hydraulic actuator, which can provide high precision movement with less maintenance requirements than a hydraulic cylinder; similar shock absorbing characteristics to hydraulic cylinders; can operate in hostile working environments; is able to handle heavy loads; and does not require an external supply of hydraulic fluid.

SUMMARY OF THE INVENTION

The present invention provides a screw-pump type electro-hydraulic actuator, which includes high precision movement and does not require an external supply of hydraulic fluid. The screw-pump type electro-hydraulic actuator preferably includes an electric motor device, a hydraulic tube, a pump piston, a spline rod, an actuator rod and a hydraulic control circuit. The hydraulic tube is terminated with a first end cap on a first end and a second end cap on an opposing second end. A first tube diameter extends from the first end cap for insertion into a first end of the hydraulic tube. A second tube diameter extends from the second end cap for insertion into a second end of the hydraulic tube. A plurality of studs are inserted through the first and second end caps. A plurality of nuts are threaded on to the plurality of studs to retain the hydraulic tube between the first and second end caps. The electric motor device preferably includes an electric motor and a gearbox. The electric motor rotates the spline rod through the gearbox in either clockwise or counterclockwise directions. One end of the spline rod is engaged with an output of the gearbox. The spline rod includes a plurality of lengthwise splines. A rod spline bearing is rotatably retained on an opposing end of the actuator rod. The gearbox is attached to the first end cap. The actuator rod is slidably retained in the second end cap. The actuator rod preferably includes a piston attachment plate on one end and a rod pin retainer on an opposing end. The spline rod may also be attached directly to the motor, which eliminates the need for the gearbox.

The pump piston preferably includes a piston base, three sets of screw pump rollers, a spline drive gear, a first piston end plate, a second piston end plate and at least two seal guide rings. The piston base preferably a spline rod bore, three sets of screw roller bores, a spline gear counterbore and at least two seal guide grooves formed in an outside perimeter thereof. Each screw roller bore includes a screw roller drive bore and a screw roller driven bore. Each set of screw pump rollers includes a drive screw pump roller and a driven screw pump roller. The spline gear counterbore is formed in a first end of the piston base. At least two seal guide grooves are formed in an outer diameter of the piston base to receive the at least two seal guide rings. A first hydraulic chamber is formed behind the pump piston and a second hydraulic chamber is formed in front of the pump piston.

The hydraulic flow circuit includes a first relief valve, a first check valve, a second relief valve, a second check valve and an accumulator. The accumulator is connected to the first hydraulic chamber through the first relief valve and the first check valve. The accumulator is connected to the second hydraulic chamber through the second relief valve and the second check valve. The first and second hydraulic chambers are connected to the accumulator through the valves to control the flow direction and pressure demand needed on both ends of the actuator. The accumulator will be set to provide hydraulic oil flow to compensate for hydraulic oil volume differences.

The drive screw pump roller includes a screw pump drive thread, a first axle rod, a second axle rod, a pump driven gear and a rear pump drive timing gear. The pump driven gear extends from a first end of the drive screw pump roller and the pump drive timing gear extends from a second end thereof. The first axle rod extends from the pump driven gear and the second axle rod extends from the pump drive timing gear. The driven screw pump roller includes a screw pump driven thread, a first driven axle rod, a second driven axle rod and a rear pump driven gear. The first driven axle rod extends from one end of the driven screw pump roller. The rear pump driven timing gear extends from an opposing end of the pump driven screw roller. The second driven axle rod 104 extends from an opposing end of the rear pump driven timing gear 106.

The spline gear includes a spline rod opening formed therethrough, which is sized to slide along a length of the spline rod. The spline gear drives the pump driven gears of the three drive screw pump rollers. The rear pump drive timing gear of the drive screw pump roller drives the rear pump driven gear of the driven screw pump roller. The screw pump drive thread of the drive screw pump roller meshes with the screw pump driven thread of the driven screw pump roller to pump hydraulic fluid from a first hydraulic chamber to a second hydraulic chamber, or from the second hydraulic chamber to the first hydraulic chamber by rotation of the spline gear in either a clockwise or counterclockwise rotation. The distance between a centerline of the driven screw pump roller and the driven screw pump roller must be precise to enable a maximum amount of the hydraulic fluid to be pumped.

The first piston end plate preferably includes a spline rod bore, three sets of pump roller axle bores, three hydraulic fluid passages and three fastener holes. The spline rod bore is formed through a center of the first piston end plate to receive spline rod. Each set of pump roller axle bores are sized to rotatably receive the first axle rod of the drive screw pump roller and the first driven axle rod of the driven screw pump roller. Each fluid passage is formed between each set of pump roller axle bores and an outer perimeter of the first piston end plate. Each fluid passage is positioned to achieve the maximum fluid flow from each set of drive and driven screw pump rollers. The three fastener holes are preferably located near the outer perimeter of the first piston end plate.

The second piston end plate preferably includes a spline rod bore, three sets of pump roller axle bores, three hydraulic fluid passages and three fastener through holes. The spline rod opening is formed through a center of the second piston end plate. Each set of pump roller axle bores are sized to rotatably receive the second axle rod of the drive screw pump roller and the second driven axle rod of the driven screw pump roller. Each fluid passage is formed between each set of pump roller axle bores and an outer perimeter of the second piston end plate. The three fastener through holes are located near the outer perimeter of the first piston end plate.

The pump piston is preferably assembled by inserting the spline rod through the spline rod bore in the first piston end plate, and inserting the spline rod into the spline rod opening of the spline drive gear, which prevents rotation of the spline drive gear, relative to the spline rod. The spline rod is inserted through the spline rod hole in the piston base and the first piston end plate is attached to a first end of the base piston base with three fasteners. The three drive screw pump rollers are inserted into the three screw roller drive bores and pivoted until the three pump driven gears mesh with spline drive gear. The three driven screw pump rollers are then inserted into the three, screw roller driven bores and pivoted until the first rear driven gears mesh with the first drive gears. The actuator rod includes an attachment plate formed on one end of and a pin retainer formed on an opposing end. An inner diameter is formed in the actuator rod for substantially all a length thereof. The inner diameter is sized to slidably and rotatably receive the spline rod bearing. Three fasteners are inserted through the attachment plate and through the second piston end and secured to a second end of the piston base.

A spline bushing is retained in the first end cap the spline bushing is used to support rotation of the spline rod. A rod bushing is retained in the second end cap. The rod bushing in the second end cap slidably supports a length of the actuator rod. At least one gasket plate is attached to the second end cap. A non-rotation flat is preferably formed on a top of the actuator rod. The gasket plate includes a D-shaped opening, which is sized to receive an outer perimeter of the actuator rod. The D-shaped opening prevents the actuator rod and the pump piston from rotating.

The screw-pump type electro-hydraulic actuator preferably works in the following way. The actuator rod is extended or retracted by supplying electric current to the electric motor. The electric motor preferably rotates the spline rod through the gearbox. Rotation in one direction by the spline rod causes the pump piston to move forward and extend the actuator rod. Hydraulic fluid in the second chamber will be forced through the pump piston by the three sets of screw pump rollers in the pump piston. The hydraulic fluid in the first chamber will support the actuator rod through the pump piston and to extend the actuator rod. The hydraulic fluid in the first chamber will be pumped to the second chamber to retract the actuator rod. The spline rod and pump piston provide precision location of the actuator rod.

Accordingly, it is an object of the present invention to provide a screw-pump type electro-hydraulic actuator, which is able to provide high precision movement with less maintenance requirements than a hydraulic cylinder, but with the same shock absorbing benefits.

It is another object of the present invention to provide a screw-pump type electro-hydraulic actuator, which is able to support a large load.

It is further object of the present invention to provide a screw-pump type electro-hydraulic actuator, which is able to operate in hostile working environments.

Finally, it is another object of the present invention to provide a screw-pump type electro-hydraulic actuator which does not require an external supply of hydraulic fluid.

These and additional objects, advantages, features and benefits of the present invention will become apparent from the following specification.

DETAILED DESCRIPTION OF THE PREFERRED EMBODIMENTS

Figure 1:
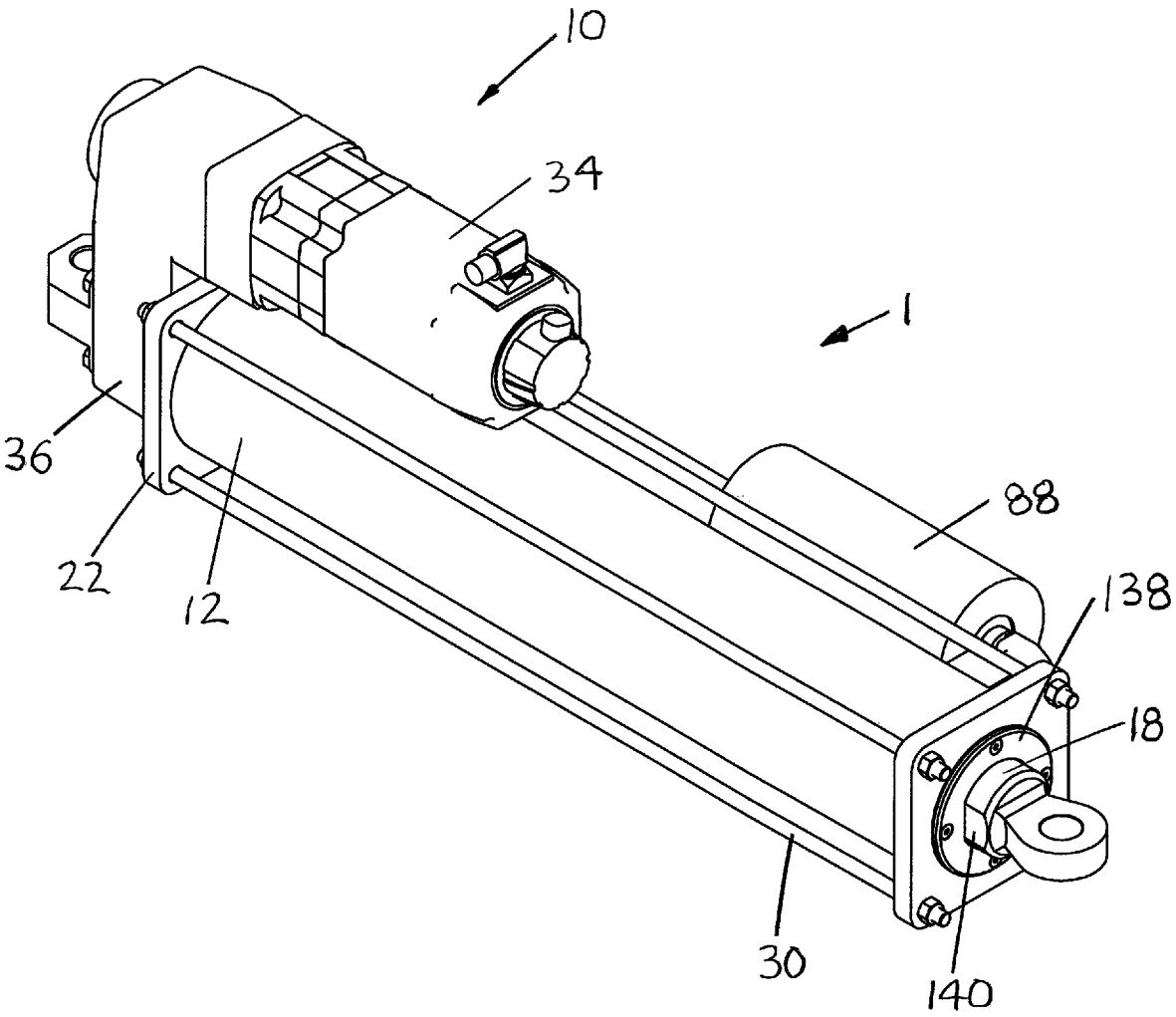
FIG. 1 is a front perspective view of a screw-pump type electro-hydraulic actuator in accordance with the present invention.
Figure 2:
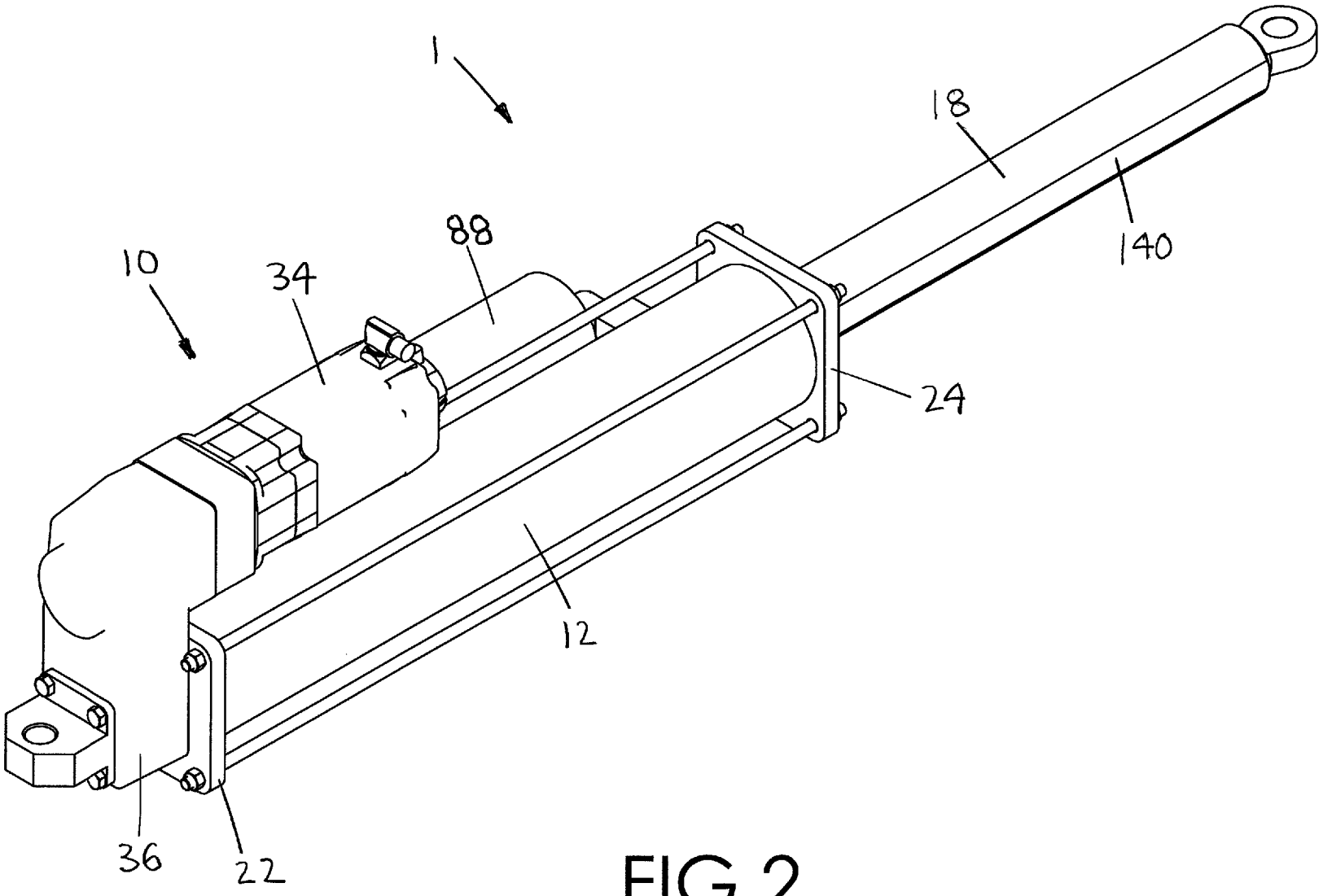
FIG. 2 is a rear perspective view of a screw-pump type electro-hydraulic actuator with an extended actuator rod in accordance with the present invention.
Figure 3:
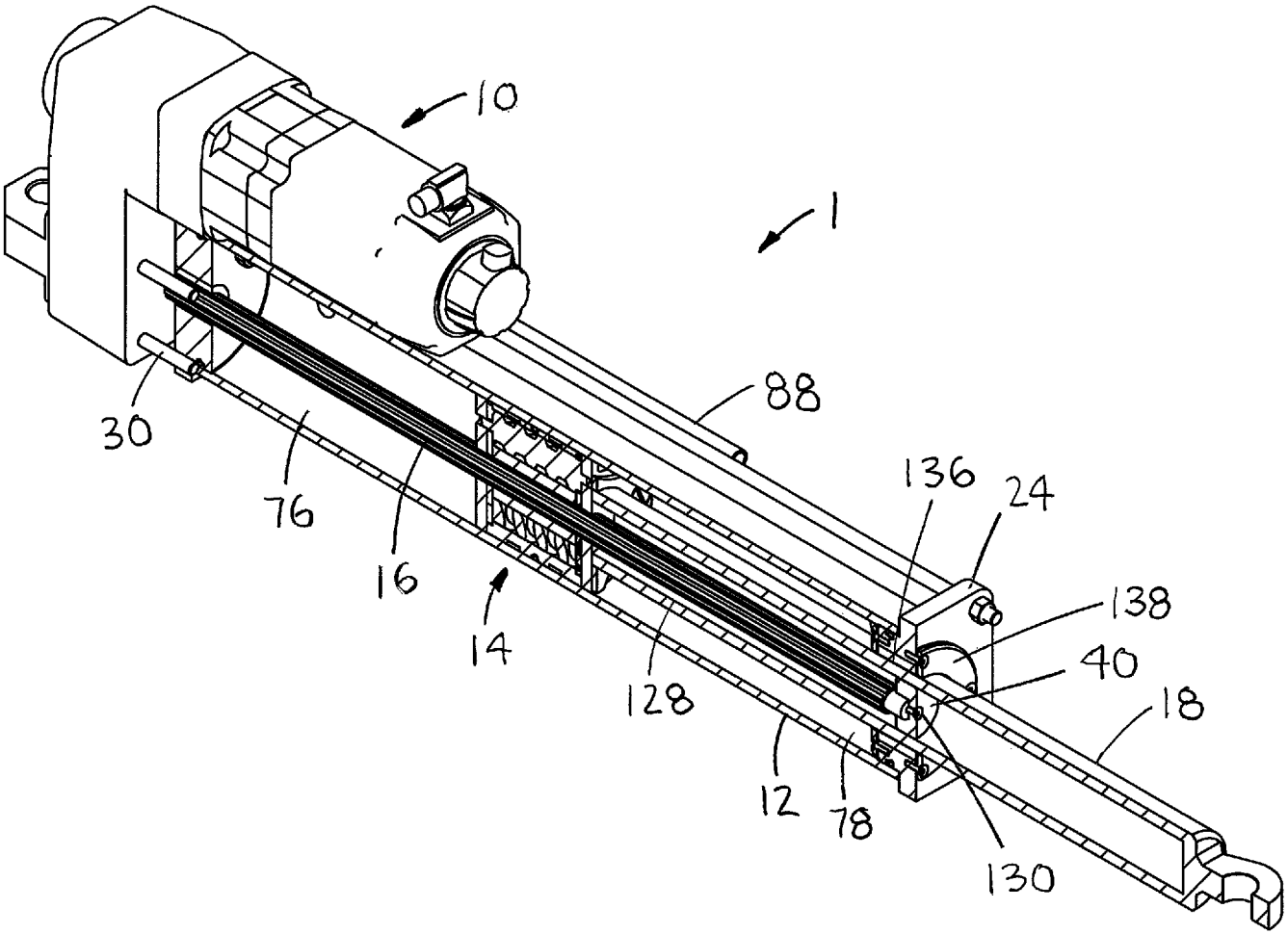
FIG. 3 is a front perspective, cut-away view of a screw-pump type electro-hydraulic actuator with an extended actuator rod in accordance with the present invention.

With reference now to the drawings, and particularly to FIG. 1, there is shown a perspective view of a screw-pump type electro-hydraulic actuator 1. With reference to FIGS. 2-6, the screw-pump type electro-hydraulic actuator 1 preferably includes an electric motor device 10, a hydraulic tube 12, a pump piston 14, a spline rod 16, an actuator rod 18 and a hydraulic control circuit 20. The hydraulic tube 12 is terminated with a first end cap 22 on a first end and a second end cap 24 on an opposing second end. A first tube diameter 26 extends from the first end cap 22 for insertion into a first end of the hydraulic tube 12. A second tube diameter 28 extends from the second end cap 24 for insertion into a second end of the hydraulic tube 12. A plurality of studs 30 are inserted through the first and second end caps 22, 24. A plurality of nuts 32 are threaded on to the plurality of studs 30 to retain the hydraulic tube 12 between the first and second end caps 22, 24. The electric motor device 10 preferably includes an electric motor 34 and a gearbox 36. The electric motor 10 rotates the spline rod 16 through the gearbox 36 in either clockwise or counterclockwise directions. One end of the spline rod 16 is engaged with an output of the gearbox 36. The spline rod 16 includes a plurality of lengthwise splines 38. A spline rod bearing 40 is rotatably retained on an opposing end of the actuator rod 18. The gearbox 36 is attached to the first end cap 22. The actuator rod 18 is slidably retained in the second end cap 24. The actuator rod 18 preferably includes a piston attachment plate 42 on one end and a rod pin retainer 44 on an opposing end.

Figure 4:
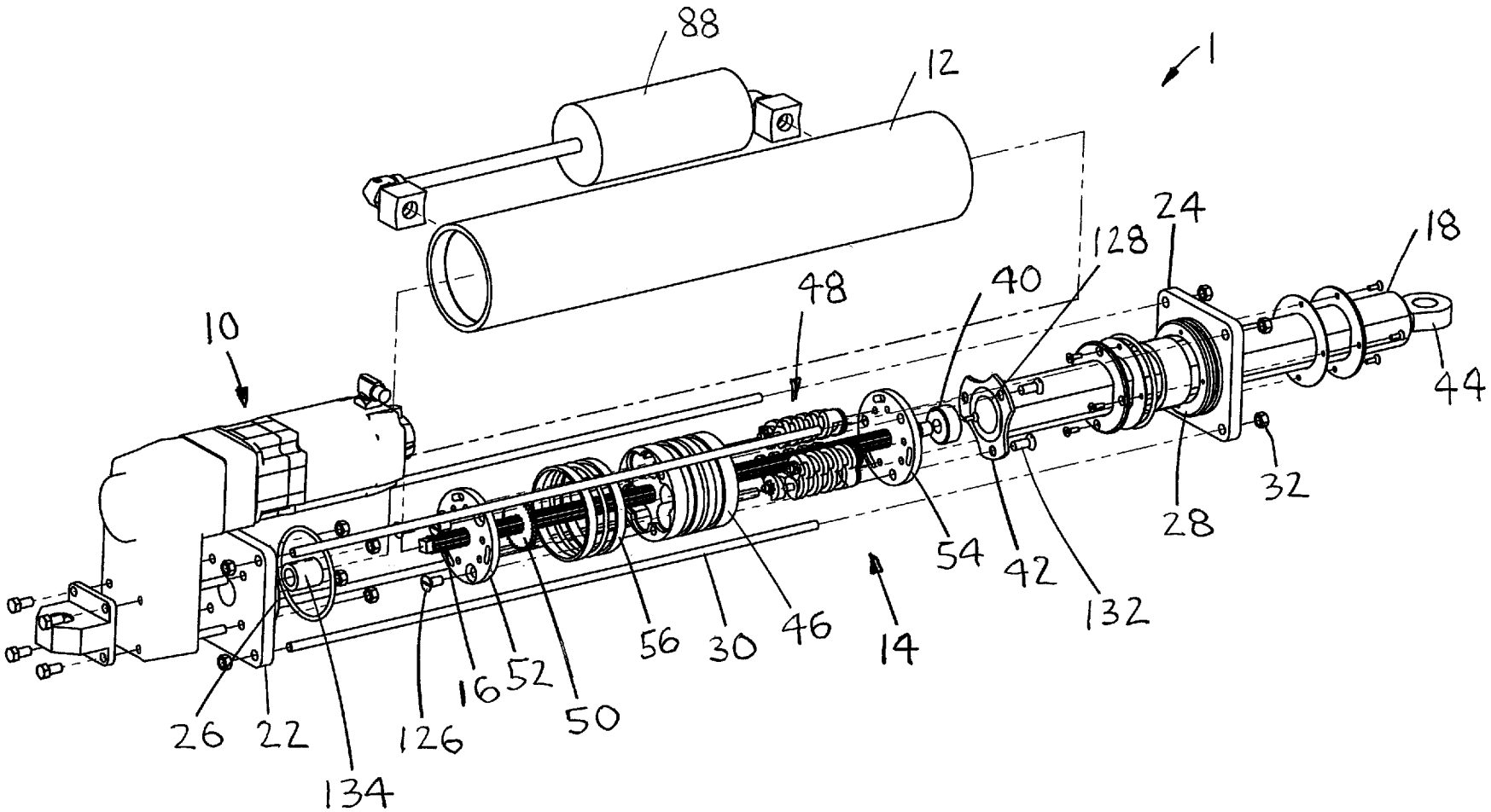
FIG. 4 is an exploded perspective view of a screw-pump type electro-hydraulic actuator in accordance with the present invention.
Figure 5:
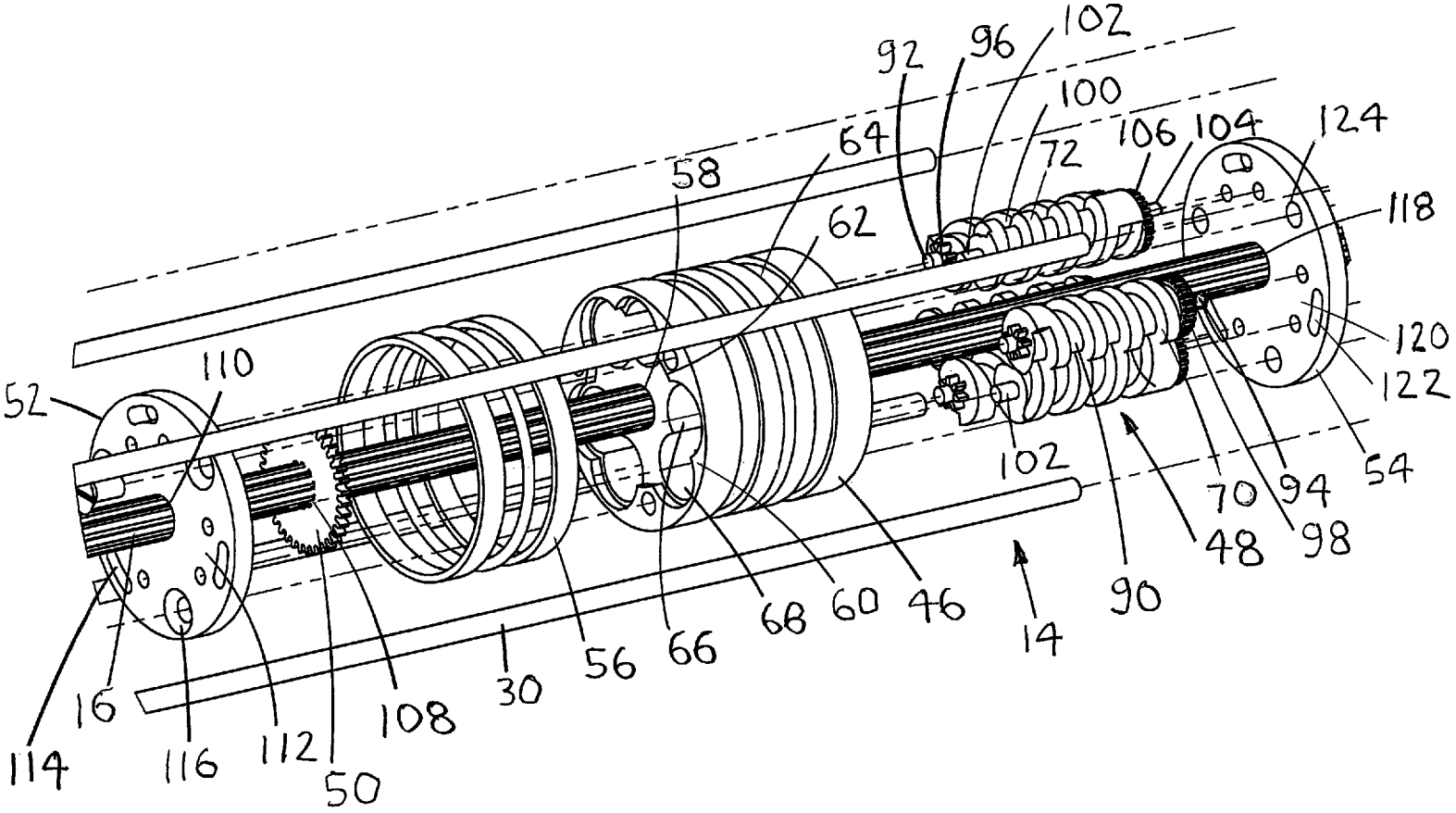
FIG. 5 is an enlarged exploded perspective view of a pump piston of a screw-pump type electro-hydraulic actuator in accordance with the present invention.
Figure 6:
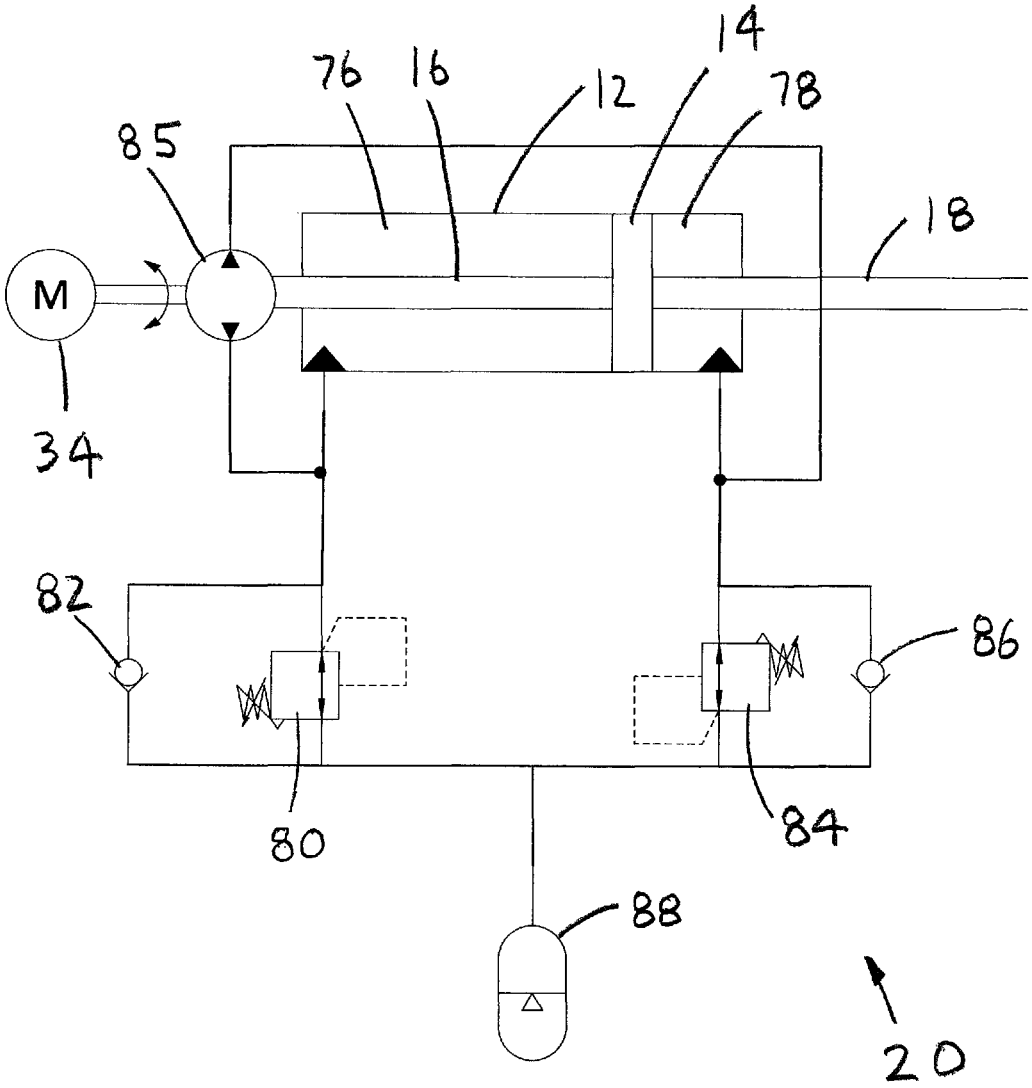
FIG. 6 is a schematic diagram of a hydraulic control circuit for a screw-pump type electro-hydraulic actuator in accordance with the present invention.

With reference to FIGS. 4-5, the pump piston 14 preferably includes a piston base 46, three sets of screw pump rollers 48, a spline drive gear 50, a first piston end plate 52, a second piston end plate 54 and at least two seal guide rings 56. The piston base 46 preferably includes a spline rod bore 58, three sets of screw roller bores 60, a spline gear counterbore 62 and at least two seal guide grooves 64 formed in an outside perimeter thereof. Each screw roller bore 60 includes a screw roller drive bore 66 and a screw roller driven bore 68. Each set of screw pump rollers 48 includes a drive screw pump roller 70 and a driven screw pump roller 72. The spline gear counterbore 62 is formed in a first end of the piston base 46. At least two seal guide grooves 74 are formed in an outer diameter of the piston base 46 to receive the at least two seal guide rings 56. A first hydraulic chamber 76 is located behind the pump piston 14 and a second hydraulic chamber 78 is located in front of the pump piston 14.

The hydraulic flow circuit 20 includes a first pressure relief valve 80, a first check valve 82, a second pressure relief valve 84, a second check valve 86 a bi-directional pump 85 and an accumulator 88. The accumulator 88 is connected to the first hydraulic chamber 76 through the first pressure relief valve 80 and the first check valve 82. The accumulator 88 is connected to the second hydraulic chamber 78 through the second pressure relief valve 84 and the second check valve 82. The first and second hydraulic chambers 76, 78 are connected to the accumulator 88 through the valves 80, 82, 84, 86 to control the flow direction and pressure demand needed on both ends of the actuator 88. The accumulator 88 will be set to provide hydraulic oil flow to compensate for hydraulic oil volume differences. The bi-directional hydraulic pump 85 will pump fluid from the accumulator into the first or section hydraulic chambers 76, 78.

The drive screw pump roller 70 includes a screw pump drive thread 90, a first axle rod 92, a second axle rod 94, a pump driven gear 96 and a rear pump drive timing gear 98. The pump driven gear 96 extends from a first end of the drive screw pump roller 70 and the pump drive timing gear 98 extends from an opposing end thereof. The first axle rod 92 extends from the pump driven gear 70 and the second axle rod extends from the pump drive timing gear 98. The driven screw pump roller 72 includes a screw pump driven thread 100, a first driven axle rod 102, a second driven axle rod 104 and a rear pump driven timing gear 106. The second driven axle rod 102 extends from one end of the driven screw pump roller 72. The rear pump driven timing gear 106 extends from an opposing end of the pump driven screw roller 72. The second driven axle rod 104 extends from an opposing end of the rear pump driven timing gear 106.

The spline gear 50 includes a spline rod opening 108 formed therethrough, which is sized to receive a cross section of the spline rod 16 and slide along a length of the spline rod 16. The spline gear drives 50 the pump driven gears 96 of the three drive screw pump rollers 48. The rear pump drive timing gear 98 of the drive screw pump roller 70 drives the rear pump driven gear 106 of the driven screw pump roller 72. The screw pump drive thread 90 of the drive screw pump roller 70 meshes with the screw pump driven thread 100 of the driven screw pump roller 72 to pump hydraulic fluid from the first hydraulic chamber 76 to the second hydraulic chamber 78, or the second hydraulic chamber 78 to the first hydraulic chamber 76 by rotation of the spline gear 50 in either a clockwise or counterclockwise rotation. The distance between a centerline of the driven screw pump roller 70 and the driven screw pump roller 72 must be precise to enable the hydraulic fluid to be pumped.

The first piston end plate 52 preferably includes a spline rod bore 110, three sets of pump roller axle bores 112, three hydraulic fluid passages 114 and three fastener holes 116. The spline rod bore 110 is formed through a center of the first piston end plate 52. Each set of pump roller axle bores 112 are sized to rotatably receive the first axle rod 92 of the drive screw pump roller 70 and the first driven axle rod 102 of the driven screw pump roller 72. Each fluid passage 114 is formed between each set of pump roller axle bores 112 and an outer perimeter of the first piston end plate 52. Each fluid passage 114 is positioned to achieve maximum fluid flow from each set of drive and driven screw pump rollers 70, 72. The three fastener holes 116 are preferably located near the outer perimeter of the first piston end plate 52.

The second piston end plate 54 preferably includes a spline rod bore 118, three sets of pump roller axle bores 120, three hydraulic fluid passages 122 and three fastener through holes 124. The spline rod bore 118 is formed through a center of the second piston end plate 54. Each set of pump roller axle bores 120 are sized to rotatably receive the second axle rod 94 of the drive screw pump roller 70 and the second driven axle rod 104 of the driven screw pump roller 72. Each fluid passage 122 is formed between each set of pump roller axle bores 120 and an outer perimeter of the second piston end plate 54. The three fastener through holes 124 are located near the outer perimeter of the second piston end plate 72.

The pump piston 14 is preferably assembled by inserting the spline rod 16 through the spline rod bore 110 in the first piston end plate 52, and inserting the spline rod 16 into the spline rod opening 108 of the spline drive gear 50, which prevents rotation of the spline drive gear 50, relative to the spline rod 16. The spline rod 16 is inserted through the spline rod bore 58 in the piston base 46. The first piston end plate 52 is attached to a first end of the piston base with three fasteners 126. The three drive screw pump rollers 70 are inserted into the three screw roller drive bores 66 and pivoted until the three pump driven gears 92 mesh with spline drive gear 50. The three driven screw pump rollers 72 are then inserted into the three screw roller driven bores 68 and pivoted, until the first rear driven gears 106 mesh with the first drive gears 98. An inner diameter 128 is formed in the actuator rod 18 for substantially all a length thereof. The inner diameter 128 is sized to slidably and rotatably receive the spline rod bearing 40.

The spline rod bearing 40 is retained on an end of the spline rod 16 with a fastener 130. Three fasteners 132 are inserted through the attachment plate 42 and through the second piston end plate 72 and secured to a second end of the piston base 46. An O-ring seal (not shown) is formed between a second piston end of the piston base 46 and the second piston end plate 54. A second O-ring seal (not shown) is formed between the second piston end plate 54 and the actuator rod 18. The O-rings are installed to prevent oil leakage through the spline rod bore 58 of the piston base 46.

A spline bushing 134 is retained in the first end cap 22 the spline bushing 134 is used to support rotation of the spline rod 16. A rod bushing 136 is retained in the second end cap 24. The rod bushing 136 in the second end cap 24 slidably supports a length of the actuator rod 18. At least one gasket plate 138 is attached to the second end cap 24. A non-rotation flat is preferably formed on a top of the actuator rod 18. The gasket plate 138 includes a D-shaped opening 140, which is sized to receive an outer perimeter of the actuator rod 18. The D-shaped opening 140 prevents the actuator rod 18 and the pump piston 14 from rotating.

The screw-pump type electro-hydraulic actuator 1 preferably works in the following manner. The actuator rod 18 is extended or retracted by supplying electric current to the electric motor 34. The electric motor 34 rotates the spline rod 16 through the gearbox 36. Rotation in one direction by the spline rod 16 causes the pump piston 14 to move forward and extend the actuator rod 18. Hydraulic fluid in the second hydraulic chamber 78 will be forced through the pump piston 14 by the three sets of screw pump rollers 48 in the pump piston 14. The hydraulic fluid in the first chamber 76 will support the actuator rod 18 through the pump piston 14 and to extend the actuator rod 18. The hydraulic fluid in the first chamber 76 will be pumped to the second chamber 78 to retract the actuator rod 18. The spline rod 16 and pump piston 14 provide precision location of the actuator rod 18.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

What is claimed:

1. A screw-pump type electro-hydraulic actuator, comprising:

an electric motor;

a hydraulic tube;

a spline rod is rotatably retained in said hydraulic tube, said spline rod is engaged with a drive shaft of said electric motor;

a pump piston includes at least two sets of screw pump rollers and a spline drive gear, said pump piston includes a spline rod hole and at least two sets of screw roller bores, said spline rod hole is sized to receive said spline rod, each said set of said screw roller bores are sized to receive one said set of screw pump rollers, said spline drive gear is retained on said spline rod; and an actuator rod extends from an end of said pump piston, wherein rotation of said spline rod rotates said at least two sets of screw pump rollers through said spline drive gear, said at least two sets of screw pump rollers pump hydraulic fluid to cause said actuator rod to extend or retract.

2. The screw-pump type electro-hydraulic actuator of claim 1, wherein:

a first hydraulic chamber is formed behind said pump piston, a second hydraulic chamber is formed in front of said pump piston.

3. The screw-pump type electro-hydraulic actuator of claim 2, further comprising:

a hydraulic control circuit includes a first relief valve, a first check valve, a second relief valve, a second check valve and an accumulator, said accumulator is connected to said first hydraulic chamber through said first relief valve and said first check valve, said accumulator is connected to said second hydraulic chamber through said second relief valve and said second check valve.

4. The screw-pump type electro-hydraulic actuator of claim 1, wherein:

said pump piston further includes a first end plate and a second end plate, said spline gear is retained between said first end plate and said pump piston, said at least two sets of screw pump rollers are rotatably retained by said first and second end plates.

5. The screw-pump type electro-hydraulic actuator of claim 1, wherein:

each said set of screw pump rollers includes a drive screw pump roller and a driven screw pump roller, said drive screw pump roller is driven by said spline drive gear on one end, said drive screw pump roller drives said driven screw pump roller on an opposing end, said drive screw pump roller meshes with said driven screw pump rollers to pump hydraulic oil.

6. The screw-pump type electro-hydraulic actuator of claim 1, wherein:

said actuator rod includes an inner diameter, said inner diameter is sized to receive said spline rod.

7. The electro-hydraulic linear lead screw actuator of claim 6, further comprising:

a rod bearing is retained on an end of said spline rod, said rod bearing is sized to be received by said inner diameter.

8. A screw-pump type electro-hydraulic actuator, comprising:

an electric motor;

a hydraulic tube;

a spline rod is rotatably retained in said hydraulic tube, said spline rod is engaged with a drive shaft of said electric motor;

a pump piston includes a pump piston base, at least two sets of screw pump rollers and a spline drive gear, said piston base includes a spline rod hole and at least two sets of screw roller bores, said spline rod hole is sized to receive said spline rod, each said set of screw roller bores are sized to receive one said set of screw pump rollers, said spline drive gear is retained on said spline rod; and an actuator rod extends from an end of said pump piston, wherein rotation of said spline rod rotates said at least two sets of screw pump rollers through said spline drive gear, said at least two sets of screw pump rollers pump hydraulic fluid to cause said actuator rod to extend or retract.

9. The screw-pump type electro-hydraulic actuator of claim 8, wherein:

a first hydraulic chamber is formed behind said pump piston, a second hydraulic chamber is formed in front of said pump piston.

10. The screw-pump type electro-hydraulic actuator of claim 9, further comprising:

a hydraulic control circuit includes a first relief valve, a first check valve, a second relief valve, a second check valve and an accumulator, said accumulator is connected to said first hydraulic chamber through said first relief valve and said first check valve, said accumulator is connected to said second hydraulic chamber through said second relief valve and said second check valve.

11. The screw-pump type electro-hydraulic actuator of claim 8, wherein:

said pump piston further includes a first end plate and a second end plate, said spline gear is retained between said first end plate and said pump piston, said at least two sets of screw pump rollers are rotatably retained by said first and second end plates.

12. The screw-pump type electro-hydraulic actuator of claim 8, wherein:

each said set of screw pump rollers includes a drive screw pump roller and a driven screw pump roller, said drive screw pump roller is driven by said spline drive gear on one end, said drive screw pump roller drives said driven screw pump roller on an opposing end, said drive screw pump roller meshes with said driven screw pump rollers to pump hydraulic oil.

13. The screw-pump type electro-hydraulic actuator of claim 8, wherein:

said actuator rod includes an inner diameter, said inner diameter is sized to receive said spline rod.

14. The electro-hydraulic linear lead screw actuator of claim 13, further comprising:

a rod bearing is retained on an end of said spline rod, said rod bearing is sized to be received by said inner diameter.

15. A screw-pump type electro-hydraulic actuator, comprising:

an electric motor;

a hydraulic tube;

a spline rod is rotatably retained in said hydraulic tube, said spline rod is engaged with a drive shaft of said electric motor;

a pump piston includes at least two sets of screw pump rollers and a spline drive gear, said pump piston includes a spline rod hole and at least two sets of screw roller bores, said spline rod hole is sized to receive said spline rod, each said set of screw roller bores are sized to receive one said set of screw pump rollers, said spline drive gear is retained on said spline rod, a first hydraulic chamber is formed behind said pump piston, a second hydraulic chamber is formed in front of said pump piston; and an actuator rod extends from an end of said pump piston, wherein rotation of said spline rod rotates said at least two sets of screw pump rollers through said spline drive gear, said at least two sets of screw pump rollers pump hydraulic fluid to cause said actuator rod to extend or retract, the hydraulic fluid in said first hydraulic chamber supports said pump piston and said actuator rod.

16. The screw-pump type electro-hydraulic actuator of claim further comprising:

a hydraulic control circuit includes a first relief valve, a first check valve, a second relief valve, a second check valve and an accumulator, said accumulator is connected to said first hydraulic chamber through said first relief valve and said first check valve, said accumulator is connected to said second hydraulic chamber through said second relief valve and said second check valve.

17. The screw-pump type electro-hydraulic actuator of claim wherein:

said pump piston further includes a first end plate and a second end plate, said spline gear is retained between said first end plate and said pump piston, said at least two sets of screw pump rollers are rotatably retained by said first and second end plates.

18. The screw-pump type electro-hydraulic actuator of claim wherein:

each said set of screw pump rollers includes a drive screw pump roller and a driven screw pump roller, said drive screw pump roller is driven by said spline drive gear on one end, said drive screw pump roller drives said driven screw pump roller on an opposing end, said drive screw pump roller meshes with said driven screw pump rollers to pump hydraulic oil.

19. The screw-pump type electro-hydraulic actuator of claim wherein:

said actuator rod includes an inner diameter, said inner diameter is sized to receive said spline rod.

20. The electro-hydraulic linear lead screw actuator of claim 19, further comprising:

a rod bearing is retained on an end of said spline rod, said rod bearing is sized to be received by said inner diameter.

* * * * *